United States Patent [19]

Tillman et al.

[11] Patent Number: 4,660,250

[45] Date of Patent: Apr. 28, 1987

[54] DOOR CLOSER

[75] Inventors: Horst Tillman, Ennepetal; Giselher Sieg, Ratingen, both of Fed. Rep. of Germany

[73] Assignee: Dorma-Baubeschlag GmbH & Co. KG., Ennepetal, Fed. Rep. of Germany

[21] Appl. No.: 747,983

[22] Filed: Jun. 24, 1985

[30] Foreign Application Priority Data

Jun. 23, 1984 [DE] Fed. Rep. of Germany ..... 3423242

[51] Int. Cl.[4] ..... E05F 3/10

[52] U.S. Cl. ..... 16/58; 16/DIG. 9; 16/DIG. 10

[58] Field of Search ..... 16/49, 51, 56, 62, 64, 16/66, 69, 84, DIG. 9, DIG. 10

[56] References Cited

U.S. PATENT DOCUMENTS

| | | | |
|---|---|---|---|
| 3,852,846 | 12/1974 | Slaybaugh | 16/62 |
| 3,934,307 | 1/1976 | Lasier et al. | 16/62 |
| 4,010,572 | 3/1977 | Peterson | 16/62 |
| 4,115,897 | 9/1978 | Zunkel | 16/62 |
| 4,369,545 | 1/1983 | Manublanc | 16/DIG. 10 |
| 4,378,612 | 4/1983 | Beers | 16/62 |
| 4,489,640 | 12/1984 | Olson | 16/56 |
| 4,502,180 | 3/1985 | Harrison et al. | 16/DIG. 10 |
| 4,580,365 | 4/1986 | Sieg | 16/49 |

*Primary Examiner*—M. Jordan

*Attorney, Agent, or Firm*—Peter K. Kontler

[57] ABSTRACT

An automatic door closer whose housing confines a reciprocable damper piston cooperating with a rotary shaft to rotate the shaft in a direction to close the door or to be moved by the shaft in response to opening of the door. The piston can be biased in a direction to close the door through the medium of the shaft by a strong coil spring as well as by a relatively weak second spring in the form of a torsion spring, an extension spring or a compression spring. The second spring ensures that the party opening the door invariably encounters some resistance to movement of the door from closed position as well as that the door begins to move toward the closed position as soon as the door opening force is reduced below the force of the second spring. The first spring is acted upon by a stressing device to ensure that such spring cannot oppose movements of the door to open position but is available to close the door with a certain delay following a relaxation of the door opening force so that the first spring can assist the second spring in closing the door if the first spring cannot close the door alone.

19 Claims, 7 Drawing Figures

III
I
I
III

V
V
M

DOOR CLOSER

BACKGROUND OF THE INVENTION

The present invention relates to door closers in general, and more particularly to improvements in door closers of the type wherein a shaft or an analogous rotary member is biased in a direction to close the door, by way of a motion transmitting device (e.g., a linkage), under the action of an energy storing device and against the opposition of a fluid operated damper.

An automatic door closer of the just outlined character is disclosed, for example, in German Offenlegungsschrift No. 32 34 319 which describes an energy storing device in the form of a spring arranged to displace a reciprocable piston of the hydraulically operated damper. The damper further includes a housing or cylinder for the piston which latter separates a plenum chamber from a second chamber and contains a check valve which can admit pressurized fluid from the second chamber into the plenum chamber. The two chambers are further connected with each other by a flow restrictor. The door closer of the German publication further comprises a stressing device which can prevent the spring from bearing upon the piston of the damper in a direction to close the door through the medium of the shaft. The stressing device is movable by a motor in a direction to cause the spring to store energy and to thus prevent the spring from urging the piston in a sense which would entail a rotation of the shaft in a direction to close the door. The motor for the stressing device is actuated in dependency on the angular position of the door. The arrangement is such that the motor and the stressing device cause the spring to store energy as soon as the door begins to leave its closed position and the motor ensures that the spring is thereupon held out of energy dissipating engagement with the piston as the door continues to move away from the closed position. The motor can act upon the stressing device mechanically, hydraulically or pneumatically. For example, a pressure monitoring device is operatively connected with the motor so as to ensure that the spring does not oppose the movement of the door to its open position. The person who is in the process of opening the door in the customary way must merely exert a force which suffices to shift the piston in its cylinder, to overcome the intertia of the pivotable door panel, to overcome friction between the components of the door hinges, to overcome friction between the elements of the linkage which couples the cylinder to the door frame, to overcome friction between the shaft and its bearings, and to overcome friction between the piston and its cylinder.

A door closer should ensure predictable shutting of the door under normal circumstances as well as under certain exceptional circumstances, e.g., in the event of a fire which entails the establishment of a pronounced pressure differential between the two sides of the door panel in a sense to maintain the door in open position. The magnitude of the pressure differential is the criterion which determines the bias of the aforediscussed spring. This can create problems in door closers of the type wherein the spring is allowed to act upon the piston of the damper with a certain delay following completion of movement of the door from its closed position. Thus, when a person who has just opened the door fails to realize that the door is equipped with a closer (because the movement of the door to its open position necessitates the exertion of a very small force), such person is likely to experience a shock or to be injured (especially a child or a senior or infirm citizen) if such person is abruptly required to resist a very pronounced closing force which is applied by the spring with the aforediscussed delay. For example, the person who has just opened the door can be involved in a conversation and fails to remember or realize that the path for movement of the door back to its closed position should be left unobstructed because the door is about to be closed under the action of a very strong spring.

OBJECTS AND SUMMARY OF THE INVENTION

An object of the invention is to provide a novel and improved door closer or door check which is constructed and assembled in such a way that the person opening the door is invariably aware of the presence of a door closer.

Another object of the invention is to provide an automatic door closer which does not offer a pronounced resistance to opening of the door but such resistance suffices to warn the operator of the inpending closing of the door with a pronounced force.

A further object of the invention is to provide the door closer with novel and improved means for urging the door to its closed position.

An additional object of the invention is to provide a door closer wherein the application of closing force is timed and its magnitude selected in a novel and improved way.

Still another object of the invention is to provide a door closer which can be designed to allow for a regulation of the closing force within a desired range.

Another object of the invention is to provide a door closer which can be used as a superior substitute for heretofore known door closers on existing doors and which can be safely manipulated by persons of all age groups.

The invention resides in the provision of an automatic door closer which comprises a fluid-containing housing (e.g., an elongated cylinder), a damper piston which is mounted in the housing for movement in a first direction during closing of the door and in a second direction during opening of the door, first energy storing means for urging the piston in the first direction with a first force, and second energy storing means for permanently urging the piston in the first direction with a second force which is weaker than the first force. The door closer further comprises motor-driven stressing means which is operable to prevent the first energy storing means from urging the piston in the first direction so that the piston can be moved in the second direction against the opposition of the second energy storing means but need not overcome the resistance of the first energy storing means.

In accordance with a first presently preferred embodiment of the invention, the second energy storing means comprises a spring which is designed to pull the piston in the first direction. The housing of such door closer comprises an end wall and the spring is preferably attached to the end wall of the housing as well as to one end portion or head of the piston to pull the latter toward the end wall.

The first and second energy storing means can be installed in the housing at one and the same side of the damper piston, and each such energy storing means can comprise a compression spring. The compression spring of the first energy storing means can be mounted in the housing in such a way that it surrounds the compression spring of the second energy storing means. The compression spring of the first energy storing means can react against one end wall of the housing and the stressing means can include a sleeve-like member which surrounds the compression spring of the second energy storing means and has an abutment (such as an outturned flange at one of its ends) against which the compression spring of the first energy storing means bears to urge the sleeve-like member toward engagement with the piston. Such stressing means can further comprise a carrier (e.g., a piston rod) which supports the sleeve-like member and is reciprocable in the housing in the first and second directions, a tubular guide or supporting member which surrounds the carrier, and cooperating entraining means provided on the sleeve-like member and on the carrier to move the abutment away from the damper piston in response to movement of the carrier in the second direction. The guide can be provided with one or more elongated slots and the entraining means of the sleeve-like member can comprise one or more male coupling elements in the form of prongs which extend into the respective slots and are reciprocable relative to the guide. The entraining means of the carrier can comprise a head which engages the prong or prongs and moves the sleeve-like member during movement of the carrier in the second direction.

The second energy storing means can comprise a torsion spring a first end portion of which is attached to the housing and a second end portion of which is attached to a rotary shaft which is mounted in the housing for rotation in response to or for the purpose of pivoting of a door panel between a closed and a selected open position. Such door closer further comprises means (e.g., a rack and pinion drive) for reciprocating the piston in response to rotation of the shaft and vice versa. The first end portion preferably constitutes the radially outermost part or convolution and the second end portion preferably constitutes the radially innermost part or convolution of the torsion spring.

The spring of the first energy storing means can constitute a relatively strong first compression coil spring and the spring of the second energy storing means can comprise a relatively weak second compression coil spring which acts directly upon the damper piston and is disposed between the piston and the first spring. Such door closer preferably further comprises a hollow extension for the first spring (the extension can constitute a detachable portion of the housing), and the stressing means then preferably comprises a second piston which is reciprocable in the extension in the first and second directions (the means for moving the second piston in the second direction can comprise a motor-driven pump) to stress the first spring in response to movement in the second direction. Such door closer further comprises means for transmitting motion from the second piston to the first piston during movement of the second piston in the first direction. The motion transmitting means can comprise an elongated displacing member in the form of a rod or the like and the extension can comprise an end wall or plug for the housing. The displacing member extends through and is reciprocable relative to the end wall of the extension.

Alternatively, the just discussed motion transmitting means can comprise a fluid-operated motion transmitting system. In this embodiment of the door closer, the housing defines for the second spring a space which is located between the first piston and the extension, and the second piston divides the interior of the extension into a first compartment which receives fluid to stress the first spring and a second compartment. The fluid-operated motion transmitting system preferably includes conduit means connecting the first compartment with the aforementioned space and valve means (e.g., a three-way solenoid valve) in the conduit means. Such door closer preferably further comprises means (e.g., a switch which is actuated in response to movement of the door panel to and from the closed position and an adjustable pressure-responsive switch) for actuating the valve so that the valve can prevent or permit the flow of fluid between the first compartment of the extension and the space for the spring of the second energy storing means.

The novel features which are considered as characteristic of the invention are set forth in particular in the appended claims. The improved automatic door closer itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
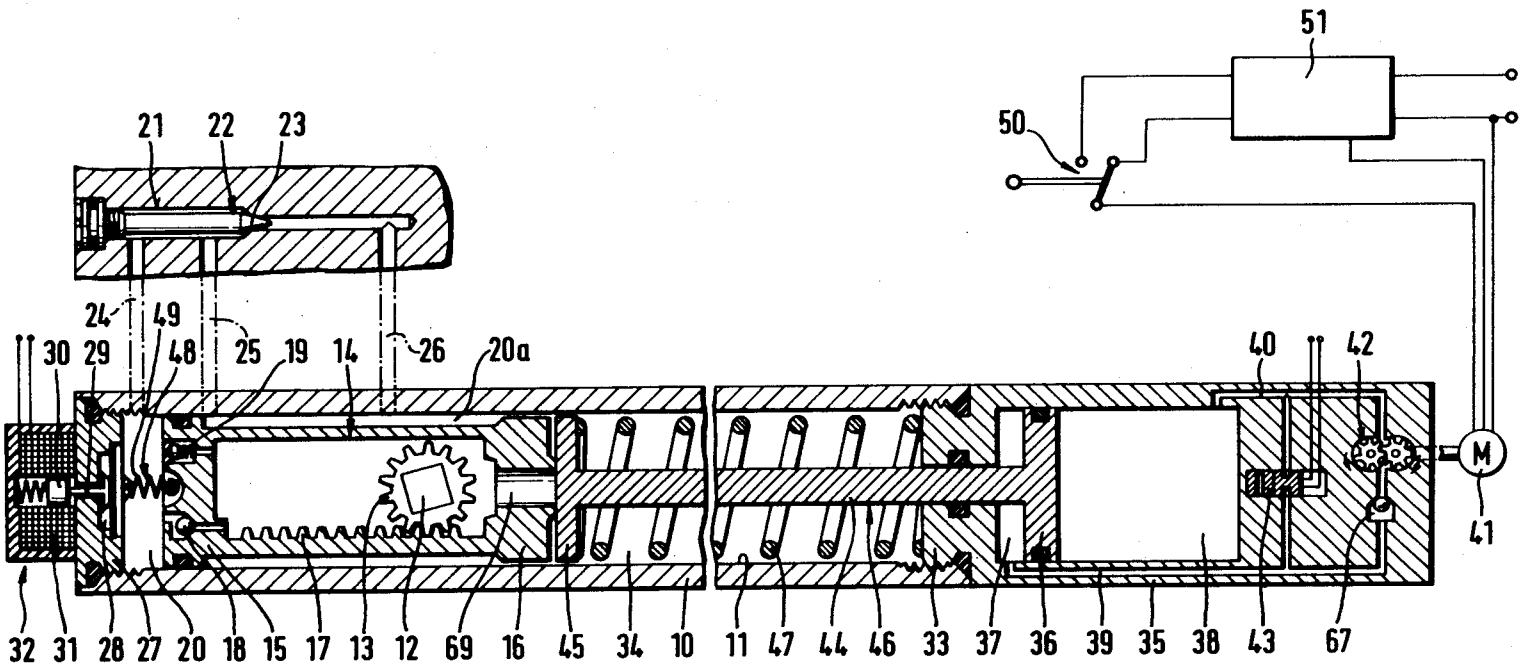
FIG. 1 is a partly diagrammatic and partly longitudinal sectional view of a door closer which embodies one form of the invention and wherein the spring of the second energy storing means is designed to pull the damper piston in the first direction.

The door closer of FIG. 1 comprises an elongated block-shaped fluid-containing housing or cylinder 10 having an elongated longitudinally extending cylindrical bore 11. Both ends of the bore 11 are closed. As can be best seen in FIG. 5, the housing 10 is further formed with a transversely extending passage which includes several cylindrical portions having different diameters and serving to receive bearing and sealing elements for a rotatable shaft 12. The just mentioned passage includes two sections which are mirror symmetrical to each other with reference to the axis of the bore 11 and each of which communicates with the bore 11. The median portion of the shaft 12 constitutes or carries a pinion 13 and the two stubs of the shaft at the opposite sides of the gear 13 are non-rotatably coupled to the corresponding end portion of a lever 112 (shown by phantom lines in FIG. 5) forming part of a linkage which connects the shaft 12 with the door frame as well as with the pivotable door panel. For example, the outermost portions of the two stubs of the shaft 12 can have a square (FIG. 5) or other polygonal outline.

The bore 11 of the housing 10 receives a damper piston 14 which is reciprocable in the housing in the axial direction of the bore 11 and includes a first enlarged end portion or head 15, a second enlarged end portion or head 16 and an elongated shank 17 which extends between the heads 15 and 16. The shank 17 constitutes a toothed rack and mates with the pinion 13 on the shaft 12. Thus, the piston 14 is caused to move in the bore 11 axially in response to rotation of the shaft 12, and the shaft 12 is set in rotary motion in response to axial displacement of the piston 14 in the housing 10.

The head 15 of the piston 14 carries a ring-shaped sealing element which is in contact with the internal surface of the housing 10, and the head 15 contains a check valve 18 which can open to permit the flow of a fluid medium through the head 15 and into a plenum chamber 20 at the left-hand axial end of the piston 14, as viewed in FIG. 1. Still further, the head 15 of the piston 14 contains a spring-biased relief valve 19 which opens automatically when the pressure in the plenum chamber 20 rises above a preselected maximum acceptable value, e.g., in response to forcible and abrupt closing of the door. One of the differences between the embodiments of FIGS. 1–6 on the one hand and the embodiment of FIG. 7 on the other hand is that, in FIG. 7, the head 16 of the damper piston 14 carries a ring-shaped sealing element in engagement with the internal surface of the housing 10. Furthermore, and whereas FIG. 1 shows a door closer with a channel 69 which extends through the piston head 16, such channel is not provided in the piston 14 of FIG. 7.

The housing 10 is further formed with a second bore 21 having several portions of progressively decreasing diameter and extending in parallelism with the bore 11. The bore 21 contains a flow restrictor 22 whose conical tip 23 is received in a complementary conical portion of the bore 21. The external threads on the left-hand end portion of the flow restrictor 22 mate with the internal threads of the adjacent portion of the housing 10. The bore 21 communicates with two transversely extending channels or bores 24, 25 which are disposed at one side of the cone 23 and with a third channel or bore 26 which is disposed at the other side of the cone 23. Those ends of the channels 24, 25 which communicate with the bore 21 can communicate with each other by way of a narrow annular space surrounding the smooth cylindrical portion of the flow restrictor 22. The bores or channels 24, 25 further communicate with the bore 11 in such a way that the bore 24 communicates with the plenum chamber 20 in that end position of the piston 14 which corresponds to the closed position of the door and the bore 25 communicates with the plenum chamber 20 in the other end position of the piston 14, namely when the door is open. The bore 25 communicates with a chamber **20*a* at the right-hand side of the head 15 in immediate or close proximity of the head 15 when the door is closed. The chamber 20*a* need not be or is not a plenum chamber; at the very least, the pressure in the chamber 20*a* is less than in the chamber 20, and these chambers are sealed from each other by the annular sealing element which is recessed into the peripheral surface of the head 15. The bore or channel 26 communicates with the chamber 20*a* at a location which is remote from the head 15 in each and every axial position of the damper piston 14**.

The left-hand end portion of the housing 10, as viewed in FIG. 1, is sealed by an externally threaded end wall or plug 27 with the interposition of one or more 0-rings or analogous sealing elements. The plug 27 has a compartment 28 which is sealed from the plenum chamber 20 by a diaphragm. The compartment 28 receives the mushroom-shaped enlarged portion of a pusher 29 which is rigid or integral with the core 30 of an inductance or moving coil 32 further including a winding 31.

The right-hand end of the housing 10 is sealed by a second end wall or plug 33. The bore 11 between the plugs 27 and 33 can be said to constitute a main cylinder chamber 34 and the plug 33 includes a hollow tubular extension 35 which defines a second cylinder chamber for a reciprocable stressing piston 36. The latter subdivides the cylinder chamber of the extension 35 into two compartments 37 and 38 which are sealed from each other by an 0-ring of the piston 36. The compartments 37 and 38 respectively communicate with conduits 39, 40 which contain a pump 42 driven by a motor 41. A regulating valve 43 is installed between the conduits 39 and 40. Portions of these conduits can constitute channels or bores which are machined into the extension 35 of the plug 33. The pump 42 can deliver a fluid from the conduit 40 into the conduit 39 by way of a check valve 67.

The stressing piston 36 is connected with a piston rod 44 which extends through a ring-shaped sealing element in the axial bore of the plug 33 and whose left-hand end portion carries a disc-shaped stressing element or plunger 45. When the door is closed, the plunger 45 abuts against the head 16 of the piston 14 and seals the passage 69 of the latter. The plunger 45 is reciprocable in the low-pressure or lower-pressure chamber of the housing 10. The piston 36, the piston rod 44 and the plunger 45 can be said to constitute a blocking device 46 which renders ineffective a compression spring (main or first energy storing device) 47 when the door is closed, i.e., when the plunger 45 abuts against the head 16. The compression spring 47 is a coil spring which reacts against the plug 33 and bears against the respective end face of the motor-driven plunger 45 in the housing 10. The purpose of the compression spring 47 is to push the damping piston 14 from a position corresponding to any of several open positions of the door to the end position in which the door is closed, provided that such (leftward) movement of the plunger 45 is not opposed by pressurized fluid in the compartment 37 of the extension 35. However, when the pump 42 supplies the compartment 37 with a pressurized fluid (by way of the check valve 67) at a pressure which suffices to overcome the bias of the spring 47, the piston 36 is caused to move in a direction to the right, as viewed in FIG. 1, whereby the plunger 45 moves away from the damping piston 14 and the latter is free to be moved axially to a position corresponding to an open position of the door whereby such movement of the piston 14 necessitates the exertion of a relatively small force.

In order to ensure that the piston 14 is invariably biased in a direction to move toward its closed position (in which the volume of the chamber 20 is reduced to a minimum value), the improved door closer further comprises a second energy storing device 48 which is weaker than the compression spring 47 and is designed to permanently pull the piston 14 to the end position of FIG. 1. In the embodiments of FIGS. 1 to 6, the energy storing device 48 comprises or consists of an extension spring 49 one end convolution of which is attached to the head 15 and the other end convolution of which is secured to the plug 27. When a person desires to open the door which is connected to the improved door closer, the door which is being opened actuates a switch 50 for a logic control system 51 which is connected between the motor 41 for the pump 42 and the energy source. The system 51 completes the circuit of the motor 41 so that the pump 42 draws a fluid (e.g., oil) from the compartment 38 and conveys it into the compartment 37 of the extension 35. This causes the plunger 45 to move in a direction to the right against the opposition of the compression spring 47. The extent of displacement of the plunger 45 in a direction to the right, as viewed in FIG. 1, is determined by the control system 51 which is designed to arrest the motor 41 for the pump 42 after a preselected interval of time. The arrangement is such that the pump 42 ceases to deliver fluid medium into the compartment 37 when the door has been moved to a selected open position, i.e., through a predetermined angle from the closed position. The just described movement of the plunger 45 under the action of the fluid which is admitted into the compartment 37 prevents the compression spring 47 from influencing the damper piston 14. If a person thereupon decides to continue with opening of the door, the door must be moved against the opposition of the relatively weak extension spring 48. As the damper piston 14 moves in a direction to the right (because the shaft 12 is rotated by the moving door), the pressure in the plenum chamber 20 decreases and drops to below atmospheric pressure so that the diaphragm in the plug 27 undergoes deformation as a result of the establishment of a pressure differential between the chamber 20 and the compartment 28 and the inductance 32 transmits a signal to the control system 51 in a sense to start the motor 41 again so that the pump 42 admits additional fluid into the compartment 37 and the compression spring 47 is caused to store additional energy. The arrangement is such that the head 16 of the damper piston 14 advances toward but continues to trail the plunger 45 and the respective end convolution of the compression spring 47. The distance by which the head 16 of the piston 14 trails the plunger 45 can be selected in advance while the door is held in the closed position. The pressure in the chamber 20 rises to its normal value when the movement of the door toward the fully open position is interrupted or completed. This is detected by the inductance 32 by way of the diaphragm in the plug 27 and the control system 51 receives an electric signal which entails a stoppage of the motor 41. The pump 42 is arrested, i.e., the effective volumes of the compartments 37 and 38 remain unchanged as soon as the motor 41 is arrested by the control system 51. In other words, the plunger 45 then cooperates with the plug 33 to ensure that the amount of energy which is stored by the compression spring 47 remains unchanged.

If the exertion of a force upon the door in a direction to move the door toward or to maintain the door in fully open position is terminated, the extension spring 49 immediately begins to pull the piston 14 in a direction to the left, as viewed in FIG. 1, and the door is compelled to pivot toward the closed position. Under normal circumstances, the door will close solely in response to the dissipation of energy by the relatively weak spring 49. However, and in order to ensure reliable closing of the door even if the latter is subjected to the action of a pronounced suction force (e.g., in the event of a fire), the control system 51 is preferably designed to actuate the regulating valve 43 with a preselected delay following stoppage of the motor 41 so that the fluid medium is free to flow from the compartment 37 into the compartment 38 without being compelled to flow through the pump 42. This enables the spring 47 to expand and to assist the weaker spring 49 in moving the door to the fully closed position even under circumstances when the spring 49 alone could not close the door. The speed at which the door can move to the closed position under the action of the spring 47 and/or 49 is determined by the hydraulic damping arrangement including the flow restrictor 22 and the channels 21, 24, 25 and 26.

In the event of power failure, i.e., when the inductance 32 and the control system 51 are out of commission, the spring 47 is free to assist the continuously acting spring 49 in moving the door to its closed position.

Figures 2, 3:
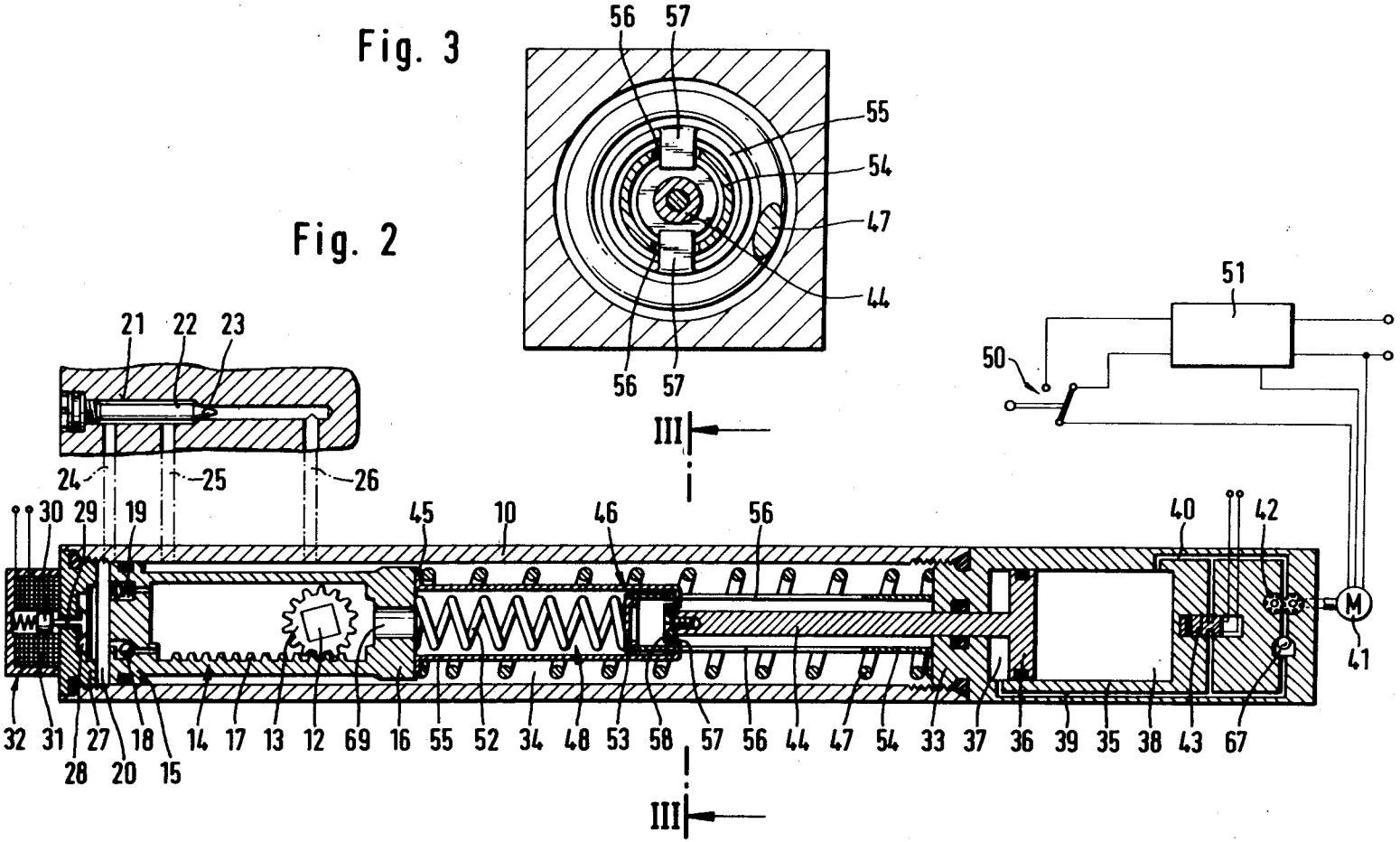
FIG. 2 is a similar partly diagrammatic and partly longitudinal sectional view of a second door closer wherein the springs of the first and second energy storing means are disposed at the same side of the damper piston.
FIG. 3 is an enlarged sectional view as seen in the direction of arrows from the line III—III of FIG. 2.

FIG. 2 shows a modified door closer. All parts which are identical or analogous to the corresponding parts of the door closer of FIG. 1 are denoted by the same characters. The same applies for the embodiments of FIGS. 4, 6 and 7. The first or main energy storing device 47 is a compression coil spring which reacts against the plug 37 and bears continuously against the stressing element or plunger 45 so that the latter is normally urged against the head 16 of the damper piston 14. The second energy storing device 48 includes a substantially weaker second compression coil spring 52 which bears at all times against the head 16 and reacts against the cover or lid 53 of a tubular supporting member or guide 54. The coil spring 52 is coaxial with the coil spring 47 and the latter surrounds the supporting member 54. The supporting member 54 is mounted on the plug 37 in the main cylinder chamber 34, the same as the coil springs 47 and 52. The piston rod 45 extends into and is spacedly surrounded by the tubular supporting member or guide 54. The plunger 45 has a sleeve-like extension or member 55 which spacedly surrounds the coil spring 52. In the embodiment of FIGS. 2 and 3, the plunger 45 is an outwardly extending abutment or flange at the left-hand end of the sleeve 55, as viewed in FIG. 2. The supporting member or guide 54 has two longitudinally extending slots 56 for male coupling or entraining elements in the form of radially inwardly extending prongs 57 of the sleeve 55. The slots 56 are disposed diametrically opposite each other. The prongs 57 are movable toward and away from a head 58 of the blocking device 46 including the suporting member 54 and its cover 53 as well as the piston rod or carrier 44.

An advantage of the door closer of FIGS. 2 and 3 is its compactness. This is due to the fact that the relatively small and relatively weak spring 52 of the second energy storing means is confined within the stronger and larger spring 47 of the first energy storing means.

Figures 4, 5:
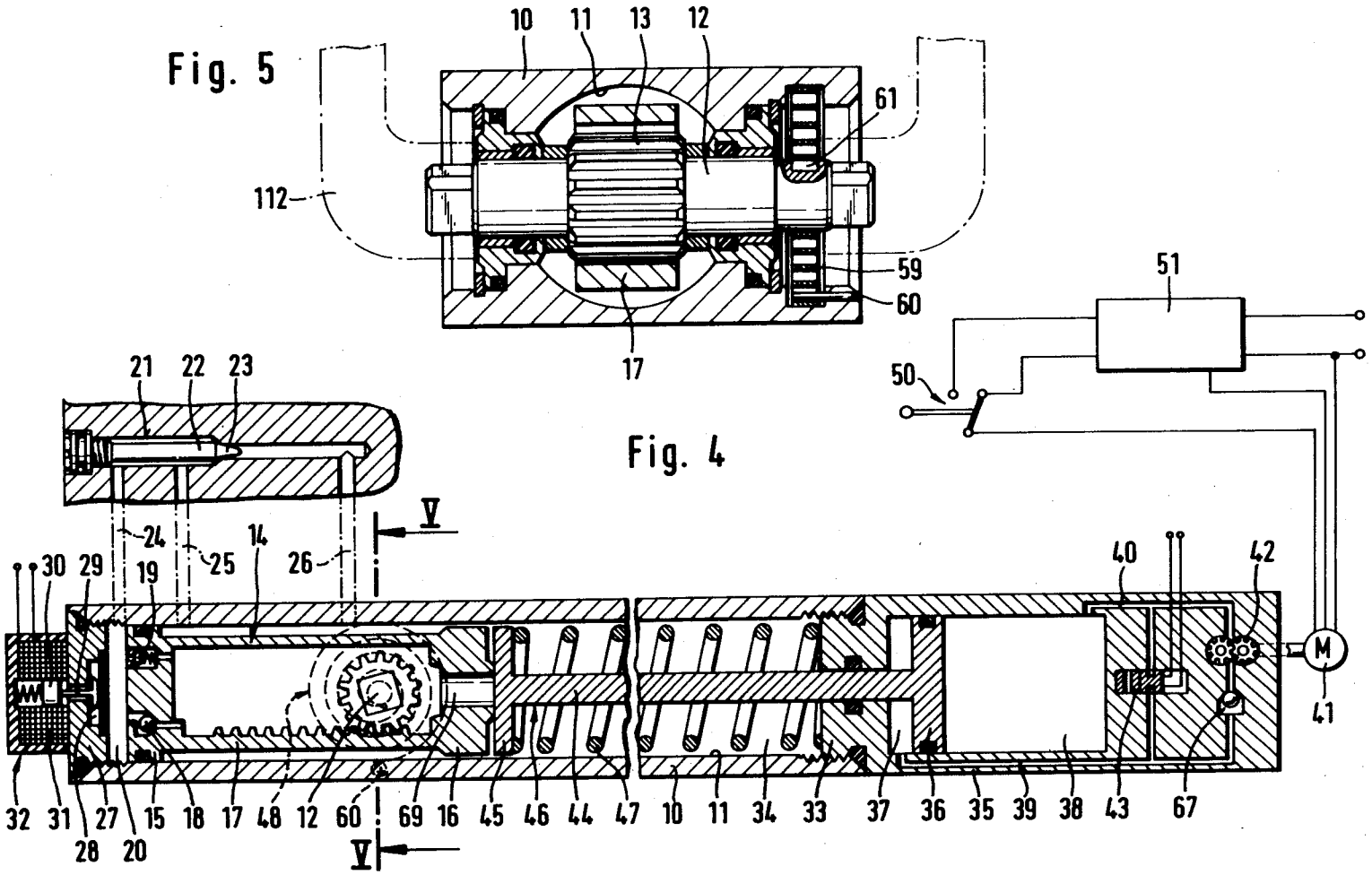
FIG. 4 is a partly diagrammatic and partly longitudinal sectional view of a third door closer wherein the second energy storing means comprises a torsion spring acting between the housing and a shaft which is operatively connected with the damper piston by a rack and pinion drive.
FIG. 5 is an enlarged sectional view as seen in the direction of arrows from the line V—V of FIG. 4.

The second energy storing device 48 of the door closer which is shown in FIGS. 4 and 5 comprises a torsion spring 59 which bears continuously upon the damper piston 14. The radially outermost end portion of the torsion spring 59 is attached to a post 60 on the housing 10 and the radially innermost end portion of the torsion spring 59 is attached to or made integral with a lug 61 which is received in a slot of the shaft 12.

The mode of operation of the door closer of FIGS. 4 and 5 is analogous to that of the door closer which is shown in FIG. 1 or in FIGS. 2–3.

Figure 6:
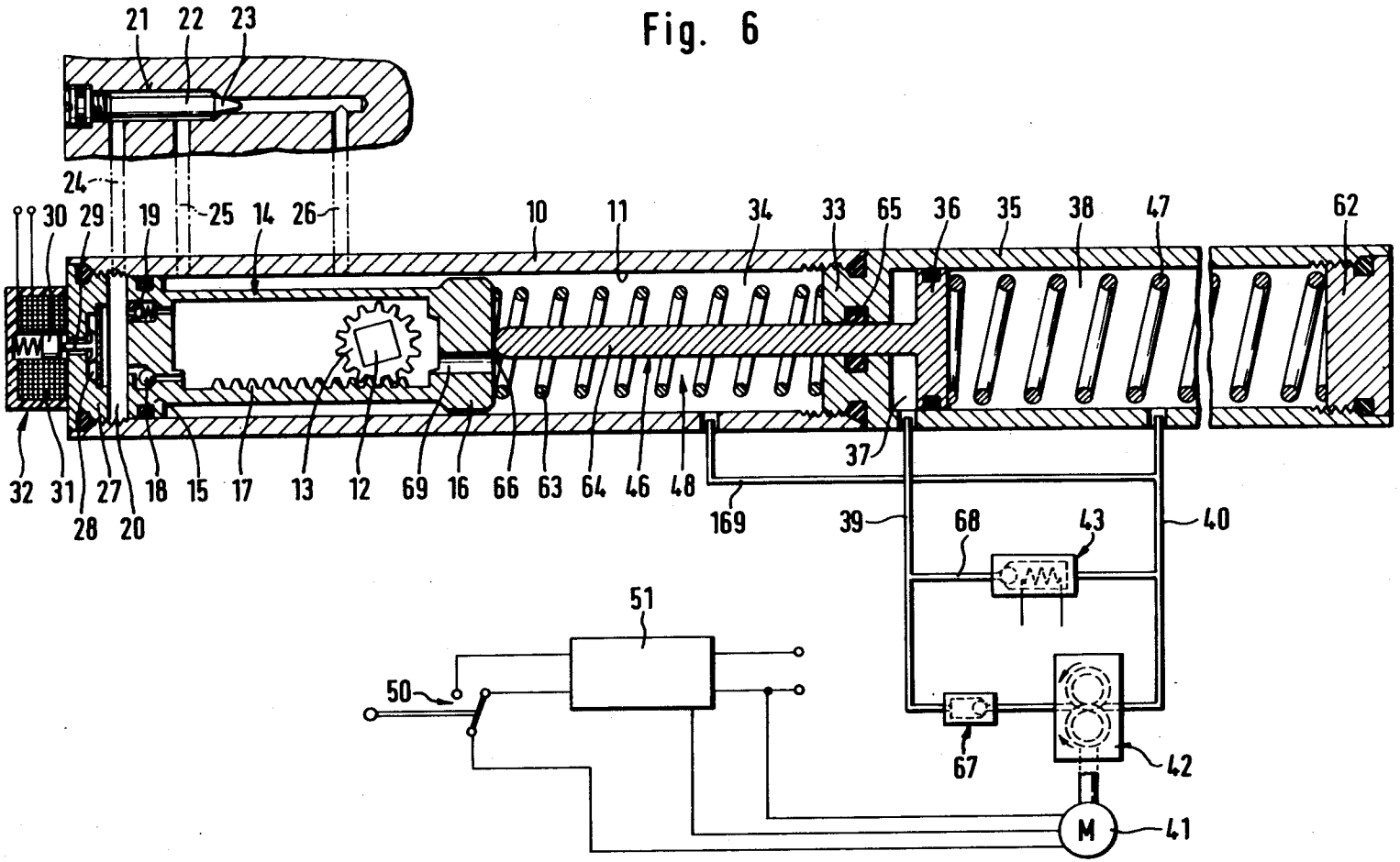
FIG. 6 is a partly diagrammatic and partly longitudinal sectional view of a fourth door closer which constitutes a modification of the door closer of FIGS. 2–3 and wherein the piston rod of the piston of the stressing means can act directly upon the damper piston.

In the embodiment of FIG. 6, the compression coil spring 47 of the first or main energy storing device is installed in the compartment or chamber 38 of the hollow tubular extension 35 including the plug 33. One end convolution of the coil spring 47 bears against the stressing piston 36 and the other end convolution of the spring 47 reacts against a detachable end wall or bung 62 sealingly installed in that end portion of the extension 35 which is remote from the plug 33.

The second energy storing device 48 comprises a compression coil spring 63 which bears directly against the head 16 of the damper piston 14 and reacts against the plug 33. The coil spring 63 is installed in the lower-pressure chamber of the housing 10 and surrounds an elongated displacing member or rod 64 which is integral with or rigidly connected to the stressing piston 36 and extends through a deformable sealing ring 65 which surrounds an axial bore of the plug 33. The rounded tip 66 of the displacing member 64 can bear against the head 16 of the damper piston 14. It can be said that, when the stressing piston 36 is caused to move in a direction to the left, as viewed in FIG. 6, the member 64 constitutes a motion transmitting connection between the pistons 14 and 36.

FIG. 6 shows the parts of the door closer in positions they assume when the door is closed. If a user moves the door panel from the closed position, the logic control system 51 receives a signal from the switch 50 (e.g., as a result of disengagement of the male (latch) and female (socket) portions of the door lock which is installed partly in the door frame and partly in the door panel) so that the motor 41 is started and drives the pump 42 which causes the hydraulic fluid to flow from the compartment 38, through the conduit 40, check valve 67 (the valve 43 is then closed) and conduit 39 into the compartment 37 whereby the stressing piston 36 causes the coil spring 47 to store energy and the piston 36 also retracts the displacing member 64 so that the shaft 12 (which is rotated by the door panel while the latter moves away from its closed position) can move the damper piston 14 in a direction to the right, as viewed in FIG. 6, with the exertion of a relatively small force including that which is necessary to overcome the resistance of the spring 63. The logic control system 51 arrests the motor 41 after a preselected interval of time which suffices to ensure that the tip 66 of the displacing member 64 remains spaced apart from the head 16 of the damper piston 14, i.e., that the party moving the door panel to a certain (e.g., fully) open position need not overcome the resistance of the rather strong spring 47. Moreover, the pressure monitoring means including the membrane in the plug 27 ensures that the distance between the tip 66 and the head 16 remains substantially unchanged or suffices to guarantee that, while the party in charge of opening the door must overcome the resistance of the weaker spring 63, such party need not cause the much stronger spring 47 to store energy during pivoting of the door panel to a selected open position.

If the movement of the door panel away from the closed position is interrupted or terminated, the inductance 32 causes the switch 50 and the control system 51 to arrest the motor 41. Moreover, the control system 51 actuates the regulating valve 43 with a preselected delay so that the valve 43 opens and establishes a path (via bypass conduit 68) for the flow of hydraulic fluid from the compartment 37 back into the compartment 38 (by way of the check valve in the conduit 68) whereby the spring 47 is free to dissipate energy and to thus reliably close the door. The damper piston 14 then rotates the shaft 12 in a direction to close the door under the action of the weaker spring 63 as well as under the action of the stronger spring 47 (via displacing member 64 which then bears against the head 16). The channel 69 connects the two low-pressure spaces in the housing 10 at the opposite sides of the head 16.

In normal use of the door closer of FIG. 6, the bias of the spring 63 suffices to close the door after the door panel is released for movement toward its closed position, i.e., the delay with which the control system 51 opens the valve 43 is such that the spring 47 must assist the spring 63 to close the door only if the closing of the door takes place longer than anticipated or customary.

A conduit 169 is provided to establish permanent communication between the compartment 38 and that portion of the main cylinder chamber 34 which is disposed between the plug 33 and the head 16 of the damper piston 14.

Figure 7:
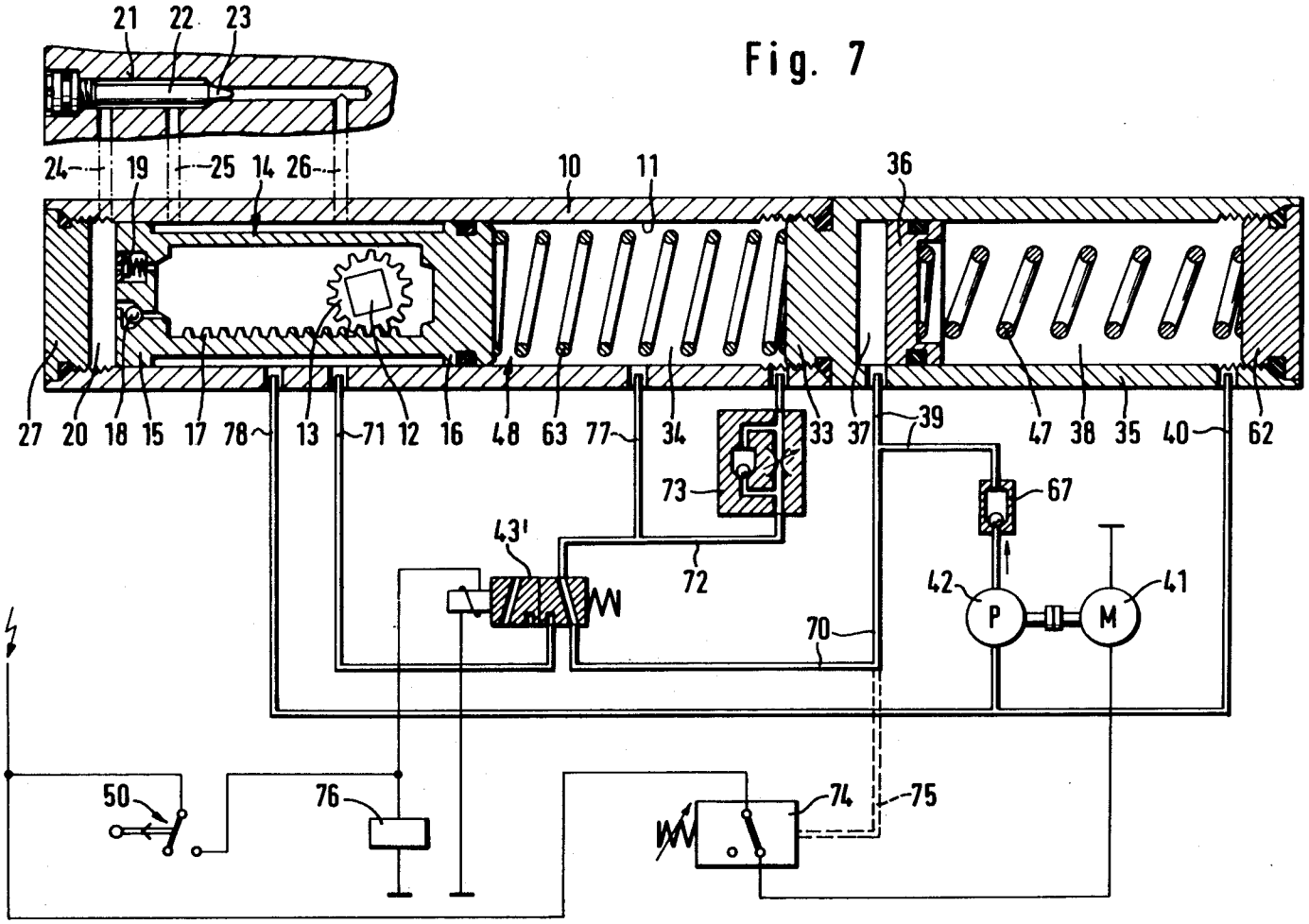
FIG. 7 is a similar partly diagrammatic and partly longitudinal sectional view of a fifth door closer wherein the first energy storing means can act upon the damper piston through the medium of a hydraulic fluid and the flow of such fluid is regulated by a three-way valve.

Referring to FIG. 7, there is shown a further door closer wherein the compression coil spring 47 of the main energy storing device is again installed in the compartment 38 of the extension 35 to react against the bung 62 and to bear against the stressing piston 36. The compartment 38 can supply hydraulic fluid for delivery to the compartment 37 by way of the conduits 39, 40 in response to starting of the pump 42 and resulting opening of the check valve 67.

The housing 10 accommodates the reciprocable damper piston 14 which is continuously acted upon by a compression coil spring 63 in the same way as described in connection with FIG. 6. Thus, the spring 63 reacts against the plug 33 and bears directly against the head 16 of the damper piston 14. The head 16 carries a sealing ring which prevents the hydraulic fluid from flowing between the spaces at the opposite sides of the head 16. The latter does not have a channel, such as the channel 69 of FIG. 1.

FIG. 7 shows all regulating and control components of the door closer in idle or inactive positions, i.e., the door closer is in a condition of total idleness. The door is closed and the male and female members of the door lock are in engagement with one another so that the switch 50 is closed and completes the circuit of the solenoid of a three-way regulating valve 43' whose circuit further includes a preferably adjustable time delay element 76. The valve 43' thereby seals a conduit or channel 70 which extends between the conduit 39 (i.e., the compartment 37) and one port of the valve 43'. At the same time, the valve 43' establishes communication between a conduit or channel 71 on the one hand and two conduits or channels 72, 77 on the other hand. The conduit 71 communicates with the low-pressure chamber between the heads 15, 16 of the damper piston 14. The conduit 72 is connected to a second port of the valve 43' and communicates with the space between the head 16 and the plug 33 by way of the conduit 77.

The motor 41 for the pump 42 can be started independently of the angular position of the door panel and independently of the position of the switch 50 by an adjustable pressure-responsive switch 74 when the pressure in the compartment 37 drops below a preselected value. The motor 41 then causes the pump 42 to convey fluid from the compartment 38 into the compartment 37 by way of the conduit 40, valve 67 and conduit 39. The piston 36 thereby causes the coil spring 47 to store energy until the switch 74 opens again because the pressure in the compartment 37, and also in the chamber between the heads 15, 16 of the piston 14, has risen to a value which is sufficient to ensure that the door is held in the closed position. The conduit 40 is connected with the chamber between the heads 15, 16 by a further conduit 78. The pressure prevailing in the compartment 37 is communicated to the adjustable pressure-responsive switch 74 by a conduit 75 which branches off the conduits 39, 70.

The maximum amount of energy which is required to ensure reliable closing of the door is then stored in the compartment 37 while the coil spring 47 ensures that such energy remains stored in the interior of the extension 35. The check valve 67 prevents the escape of the pressurized fluid from the compartment 37 by way of the conduit 39. The flow of fluid from the conduit 39 to the conduit 72 or 77 is blocked by the regulating valve 43'.

If a person or a machine thereupon moves the door from its closed position, the switch 50 opens automatically as soon as the door lock is opened and the condition of the solenoid of the regulating valve 43' is changed so that the valve 43' ceases to block the flow of pressurized fluid from the conduit 39 with a delay which is determined by the setting of the time delay element 76. For example, the time delay element 76 can be designed to delay a change in the condition of the solenoid of the regulating valve 43' for a selected interval of up to 20 seconds. This means that, during the interval which is determined by the setting of the time delay element 76, the door can be opened against the opposition of the relatively weak coil spring 63 and such opening is not opposed by the much stronger spring 47. As the door panel moves away from its closed position, the head 16 of the damper piston 14 moves in a direction to the right, as viewed in FIG. 7, and expels hydraulic fluid from the space between the head 16 and the plug 33 by way of the conduit 77 and regulating valve 43' into the conduit 71 whence the fluid flows into the lowpressure chamber between the heads 15 and 16 of the damper piston 14. When the head 16 advances beyond the adjacent end of the channel 77 (i.e., between the upper end of the channel 77, as viewed in FIG. 7, and the plug 33), the fluid which flows from the space between the head 16 and the plug 33 must pass through an adjustable flow restrictor 73 in the right-hand portion of the channel 72. This entails a damping of the movement of the door panel toward the fully open position.

When the movement of the door panel to a selected open position is terminated, the spring 63 immediately begins to move the panel back toward the closed position. This causes the fluid (which has passed from the chamber between the heads 15, 16 into the plenum chamber 20 by way of the check valve 18 during movement of the door panel to its open position) to flow back into the chamber between the heads 15, 16 by way of the flow restrictor 22. The fluid then flows from the chamber between the heads 15, 16 into the space for the coil spring 63 by way of the conduit 71, regulating valve 43' and conduits 72, 77. The flow restrictor 73 does not oppose the flow of fluid from the valve 43', via conduit 72 and into the space for the coil spring 63.

If the door is closed before the elapse of the interval which is selected by the time delay element 76, the door lock causes the switch 50 to energize the solenoid of the regulating valve 43' so that the valve 43' blocks the flow of fluid from the compartment 37, i.e., the energy which is stored by the coil spring 47 is not dissipated. This stands to reason because the dissipation of such energy is not necessary for the closing of the door. However, if the force of the relatively weak spring 63 does not suffice to close the door (i.e., to close the switch 50 by way of the door lock), the condition of the solenoid of the regulating valve 43' is changed after the elapse of the interval which is selected by the time delay element 76 so that the conduit 70 is free to communicate with the conduits 72 and 77 via valve 43'. The pressure of fluid in the space for the spring 63 rises so that the head 16 of the damper piston 14 is acted upon by pressurized fluid to move in a direction to the left, as viewed in FIG. 7, and assist the intentionally weak coil spring 63 in reliably closing the door. The closing movement is terminated when the door lock is closed to energize the solenoid of the regulating valve 43' by way of the switch 50. As the pressure in the compartment 37 drops because the fluid can flow into the space for the spring 63), the conduit 75 ensures that the pressure-responsive switch 74 reacts and starts the motor 41 for the pump 42 which feeds fluid into the compartment 37 in order to ensure that the spring 47 stores the required amount of energy.

In the event of absence of electrical energy for the motor 41 and the solenoid of the valve 43' (e.g., during a blackout), the improved door closer can still ensure reliable closing of the door in the following way: If a person or a machine opens the door, the head 16 of the damper piston 14 causes the fluid to leave the space for the valve 63 by way of the conduits 72, 77, valve 43' and conduits 70, 39 to flow directly into the compartment 37 at the left-hand side of the stressing piston 36 and to thus ensure that the spring 47 stores the required amount of energy. Thus, the person or the machine must supply the entire force which is needed to compress the spring 47 by moving the piston 36 in a direction toward the bung 62, substantially in the same way as in a conventional door closer. The piston 36 then causes the fluid to flow from the compartment 38 into the chamber between the heads 15, 16 of the piston 14 by way of the conduits 40 and 78. The energy which is stored by the spring 47 invariably suffices to ensure a reliable closing of the door as soon as the door panel is released or is caused or allowed to offer a sufficiently reduced resistance to a movement toward its closed position.

The improved door closer is susceptible of many additional modifications without departing from the spirit of the invention. For example, the hydraulic tensioning means for the coil spring 47 can be replaced or assisted by mechanical tensioning means (such as a suitable transmission) and/or by pneumatic tensioning means.

An important advantage of the door closer is that a person manipulating the door panel is invariably and continuously aware of the fact that the door is equipped with an automatic door closer and this greatly reduces the likelihood that such person would be overly surprised if and when the door closer begins to exert a greater force in a direction to close the door after the elapse of a predetermined interval of time following termination of the movement of the door panel to a selected open position. Moreover, the relatively weak spring of the second energy storing means will normally close the door before the spring of the first energy storing means has a chance to become active and to actually influence the movement of the door panel to the closed position. An additional advantage of the improved door closer is that the force with which the first energy storing means including the compression coil spring 47 can act upon the door panel through the medium of the piston 14 and shaft 12 can be reduced by the magnitude of the force of the compression, torsion or extension spring of the second energy storing means. This renders it possible to reduce the dimensions of the parts which confine, guide and stress the spring 47.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An automatic door closer comprising a fluid-containing housing; a damper piston mounted in said housing for movement in a first direction during closing of the door and in a second direction during opening of the door; first energy storing means for urging said piston in said first direction with a first force; second energy storing means for permanently urging said piston in said first direction with a second force which is weaker than said first force; stressing means operable to prevent said first energy storing means from urging said piston in said first direction so that the piston is then movable in said second direction against the opposition of said second energy storing means but the piston need not overcome the resistance of said first energy storing means; motor means actuatable to operate said stressing means; and means for actuating said motor means.

2. The door closer of claim 1 wherein said second energy storing means comprises a spring which is arranged to pull said piston in said first direction.

3. The door closer of claim 2, wherein said housing includes an end wall and said spring is an extension spring attached to said piston and to said end wall.

4. The door closer of claim 1, wherein said first and second energy storing means are installed in said housing at one side of said piston.

5. The door closer of claim 4, wherein each of said energy storing means comprises a compression spring.

6. The door closer of claim 5, wherein the compression spring of said first energy storing means surrounds the compression spring of said second energy storing means.

7. An automatic door closer comprising a fluid-containing housing including an end wall; a damper piston mounted in said housing for movement in a first direction during closing of the door and in a second direction during opening of the door; first energy storing means for urging said piston in said first direction with a first force; second energy storing means for permanently urging said piston in said first direction with a second force which is weaker than said first force, said first and second energy storing means being installed in said housing at one side of said piston and each thereof comprising a compression spring, the compression spring of said first energy storing means surrounding the compression spring of said second energy storing means and the compression spring of said first energy storing means reacting against said end wall; stressing means operable to prevent said first energy storing means from urging said piston in said first direction so that the piston is then movable in said second direction against the oppostion of said second energy storing means but the piston need not overcome the resistance of said first energy storing means; and motor means actuatable to operate said stressing means, said stressing means comprising a sleeve-like member which surrounds the compression spring of said second energy storing means and has an abutment against which the compression spring of said first energy storing means bears to urge said sleeve-like member toward engagement with said piston.

8. The door closer of claim 7, wherein said stressing means further comprises a carrier which supports said sleeve-like member and is reciprocable in said housing in said first and second directions, a tubular guide surrounding said carrier, and cooperating entraining means provided on said sleeve-like member and said carrier to move said abutment away from said piston in response to movement of said carrier in said second direction.

9. The door closer of claim 8, wherein said guide has an elongated slot and the entraining means of said sleeve-like member comprises a prong which extends into and is reciprocable along said slot.

10. The door closer of claim 9, wherein the entraining means of said carrier includes a head which engages said prong and moves said sleeve-like member during movement of said carrier in said second direction.

11. The door closer of claim 1, wherein said second energy storing means comprises a torsion spring having a first end portion attached to said housing and a second end portion, and further comprising a rotary shaft mounted in said housing and connected to the second end portion of said spring and means for reciprocating said piston in response to rotation of said shaft and vice versa.

12. The door closer of claim 11, wherein said reciprocating means comprises a rack and pinion drive, said first end portion constituting the radially outermost part and said second end portion constituting the radially innermost part of said spring.

13. An automatic door closer comprising a fluid-containing housing; a damper piston mounted in said housing for movement in a first direction during closing of the door and in a senond direction during opening of the door; first energy storing means for urging said piston in said first direction with a first force; second energy storing means for permanently urging said piston in said first direction with a second force which is weaker than said first force, said first energy storing means comprising a first spring and said second energy storing means comprising a second spring which acts directly upon said piston and is disposed between said piston and said first spring; a hollow extension for said first spring; stressing means operable to prevent said first energy storing means from urging said piston in said first direction so that the piston is then movable in said second direction against the opposition of said second energy storing means but the piston need not overcome the resistance of said first energy storing means; and motor means for operating said stressing means, said stressing means comprising a second piston which is reciprocable in said extension in said first and second directions to stress said first spring in response to movement in said second direction.

14. The door closer of claim 13, further comprising means for transmitting motion from said second piston to said first piston during movement of said second piston in said first direction.

15. The door closer of claim 14, wherein said motion transmitting means comprises a displacing member and said extension comprises an end wall for said housing, said displacing member extending through and being reciprocable relative to said end wall.

16. The door closer of claim 14, wherein said motion transmitting means comprises a fluid-operated motion transmitting system.

17. The door closer in claim 16, wherein said housing defines a space for said second spring and such space is located between said first piston and said extension, said second piston dividing the interior of said extension into a first compartment which receives fluid to stress said first spring and a second compartment, said system including conduit means connecting said first compartment with said space and valve means in said conduit means.

18. The door closer of claim 17, wherein said valve means comprises a three-way valve.

19. The door closer of claim 18, further comprising means for actuating said valve so that said valve can prevent or permit the flow of fluid between said first compartment and said space.

* * * * *